US007035413B1

(12) United States Patent
Waller, Jr. et al.

(10) Patent No.: US 7,035,413 B1
(45) Date of Patent: Apr. 25, 2006

(54) DYNAMIC SPECTRAL MATRIX SURROUND SYSTEM

(75) Inventors: James K. Waller, Jr., 9901 Allen Rd., Clarkston, MI (US) 48348; Derek F. Bowers, Sunnyvale, CA (US)

(73) Assignee: James K. Waller, Jr.

( * ) Notice: Subject to any disclaimer, the term of this patent is extended or adjusted under 35 U.S.C. 154(b) by 0 days.

(21) Appl. No.: 09/544,657

(22) Filed: Apr. 6, 2000

(51) Int. Cl.
*H04R 5/00* (2006.01)

(52) U.S. Cl. ..... 381/17

(58) Field of Classification Search ..... 381/1, 381/17–23, 119, 27, 307, 99, 4, 7, 10, 12, 381/16

See application file for complete search history.

(56) References Cited

U.S. PATENT DOCUMENTS

| | | | | |
|---|---|---|---|---|
| 4,905,284 | A * | 2/1990 | Kwang | 381/27 |
| 5,319,713 | A | 6/1994 | Waller, Jr. | 381/22 |
| 5,333,201 | A | 7/1994 | Waller, Jr. | 381/22 |
| 5,638,452 | A * | 6/1997 | Waller, Jr. | 381/22 |
| 5,642,423 | A * | 6/1997 | Embree | 381/22 |
| 5,644,640 | A * | 7/1997 | Fosgate | 381/18 |
| 5,771,295 | A * | 6/1998 | Waller, Jr. | 381/18 |
| 5,796,844 | A | 8/1998 | Griesinger | 381/18 |
| 5,870,480 | A * | 2/1999 | Griesinger | 381/18 |
| 6,198,826 | B1 * | 3/2001 | Cowieson et al. | 381/18 |
| 6,711,266 | B1 * | 3/2004 | Aylward | 381/22 |
| 6,718,039 | B1 * | 4/2004 | Klayman et al. | 381/1 |

* cited by examiner

*Primary Examiner*—Vivian Chin
*Assistant Examiner*—Lun-See Lao
(74) *Attorney, Agent, or Firm*—Frank J. Catalano

(57) ABSTRACT

A dynamically variable spectral matrix surround system decodes two-channel stereo into multi-channel surround. In one embodiment, the true stereo signal is present in left and right front and left and right surround channel outputs. When a dominant center channel signal appears, the system subtracts center channel audio from the critical voice band only. The higher frequency portion of the spectrum will remain true stereo at all times. In another embodiment, the front center signal bandwidth is determined. A dynamically variable portion of the audio spectrum is inverted and added to the opposite channel, thereby dynamically subtracting the bandwidth of the front center signal from the left front, left surround, right front and right surround channels but leaving the portion of the audio spectrum that does not contain front center information unaltered. The input is divided into two frequency bands. The low frequency portion remains true stereo at all times because only high frequencies are processed by cancellation steering. By dynamically varying the cancellation bandwidth in the left and right output channels, the typical audible dominance of the difference signals is greatly reduced. When the input contains a dominant left or right signal, the center front and surround channels are steered down in level so as to produce the output only in the front channels. When a dominant surround signal is present in the input, the front channels are steered down in level. Therefore, allows the system produces an output only in the channel where the originally encoded signal was intended.

25 Claims, 7 Drawing Sheets

DYNAMIC SPECTRAL MATRIX SURROUND SYSTEM

BACKGROUND OF THE INVENTION

The present invention relates generally to audio sound systems and more particularly concerns audio sound systems which can decode two-channel stereo into multi-channel sound, commonly referred to as "surround" sound. Typical prior art systems have utilized a variable output matrix for decoding a given signal into multi-channel outputs. Surround matrix systems capable of providing more than two output channels are well known. The Dolby Prologic® system is to date perhaps the best known example of a variable output matrix system that can decode a stereo encoded signal into four channels. For several years there has been a desire to increase the number of output channels in a matrix system to five or more. There has also been a desire to provide stereo performance in the rear surround channels. This is especially desirable when using a matrix system to decode non-encoded stereo music. U.S. Pat. Nos. 5,319,713 and 5,333,201 disclose a surround system which provide a stereo surround signal by steering a mono L−R signal in multiple bands. While this system will provide a stereo perception by steering dominant left or right signals in multiple bands, it lacks the finer detail or resolution of a true stereo signal. The surround system disclosed in U.S. Pat. No. 5,796,844 will provide a true stereo left and right surround signal when no dominant front center signal is present. When a dominant front center signal is present the '844 patent system reverts to mono in the surround channels or must compromise the front to rear separation of the center information. As a result, the '844 system frequently produces a mono signal in the surround channel outputs when there is a dominant front center signal. The left to right separation of the surround channels is one of the most important aspects of the surround system performance as perceived by the listener. The better the left/right stereo separation of the system, including the surround channels, the better the perceived performance of the system. In most of the matrix systems available today, the low frequency portion of the spectrum is dynamically changing when there is any active steering in the matrix. This will tend to produce subtle but noticeable instability at the bass frequencies. Furthermore, all of the matrix surround systems exhibit a noticeable increase in reverberation when decoding non-encoded stereo music compared to a stereo playback.

It is, therefore, a primary object of the current invention to provide a dynamic spectral matrix surround system which maintains maximum true stereo performance in the left and right front and left and right surround channels. It is also an object of the invention to provide a dynamic spectral matrix surround system which maintains true stereo operation in the high frequency portion of the spectrum when there is no high frequency center channel information present. A further object of the invention is to provide a dynamic spectral matrix surround system which affords maximum perceived removal of the front center signal in the left and right front and left and right surround channels while simultaneously providing maximum stereo separation. Another object of the invention is to provide a dynamic spectral matrix surround system which improves the stability of the bass frequencies during the dynamic steering of the matrix. Yet another object of the present invention is to provide a dynamic spectral matrix surround system that is compatible with all matrix encoded material, as well as all non-encoded stereo material. And it is an object of the present invention to provide a dynamic spectral matrix surround system which reproduces non-encoded stereo material with a more correctly balanced level of difference information, thereby reducing the typical increase of originally recorded reverberation.

SUMMARY OF THE INVENTION

In accordance with the invention, a dynamically variable spectral matrix surround system is provided which can decode two-channel stereo material into multi-channel surround. The left input is fed to both the left front and left surround channels. The right input is fed to both the right front and right surround channels. The center channel output receives a summed left and right signal. In one embodiment, the true stereo signal is present in the left and right front and the left and right surround channel outputs. When a dominant center channel signal appears, the system will provide cancellation of the center channel audio in the critical voice band only. The higher frequency portion of the spectrum will remain true stereo at all times. In another embodiment of the invention, the front center signal bandwidth is determined. A dynamically variable portion of the audio spectrum is inverted and added to the opposite channel, thereby dynamically subtracting the bandwidth of the front center signal from the left front, left surround, right front and right surround channels. The portion of the audio spectrum that does not contain front center information is unaltered and thus remains true stero in the left front, left surround, right front and right surround output channels. This greatly improves the true stereo soundfield for the listener while simultaneously reducing the typical increase of audible difference signals. The net result is a decoded output with a closer level of difference information to that of the original stereo input source material. The input is divided into two frequency bands with a 24 db per octave crossover at approximately 200 Hz. The low frequency portion of the spectrum remains true stereo at all times, due to the fact that only frequencies above 200 Hz are processed by cancellation steering. By dynamically varying the cancellation bandwidth in the left and right output channels, the typical audible dominance of the difference signals is greatly reduced. This provides a surround system with a much closer sonic balance of difference information to that of the original stero recording. When the input contains a dominant left or right signal, the center front and surround channels are steered down in level so as to produce the output only in the front channels. When a dominant surround signal is present in the input, the front channels are steered down in level. This allows the system to produce an output only in the channel where the originally encoded signal was intended. The dynamic spectral matrix surround system provides a higher level of left to right separation in all channels than was previously available with a matrix decoding system. It maintains this higher level of left to right separation regardless of the encoded direction of the input signal. The low frequency portion of the spectrum maintains true stereo performance at all times. The center channel attenuation in the left and right channels is greater than that typically obtained with a matrix system, thereby improving the channel separation. The difference information present in the input signal decodes with a much closer balance with that of the original stereo signal.

In its simplest four speaker form, the process for dynamically decoding two channel stereo into multi-channel sound includes the steps of feeding left and right input signals to left and right front and surround channel outputs, respectively, summing the left and right input signals to provide a summed signal, determining when the summed signal is dominant, and subtracting the right and left input signals from the left and right surround channel outputs, respectively, when the summed signal is dominant.

If center front and/or surround speakers are also desired, the process further includes the steps of feeding the summed signal to a center front channel output and/or differencing the right and left input signals to provide a center surround signal at a center surround channel output.

The process can be enhanced in the four speaker systems by filtering the left and right input signals over a preselected bandwidth to provide left and right filtered signals for subtraction from the right and left surround channel ouputs, respectively, when the summed signal is dominant. Similarly, the five or six speaker systems can be enhanced by filtering the summed signal over the preselected bandwidth to provide a center front signal at a center front channel output and/or differencing the right and left input signals to provide a differenced signal and filtering the differenced signal over the preselected bandwidth to provide a center surround signal at a center surround channel output. Any of these filtered systems can be further enhanced by dynamically filtering rather than fixed filtering the left, right, summed and differenced signals.

In the basic, fixed filtered and dynamically filtered four, five or six speaker systems, further enhancement can be achieved by splitting the left and right input signals into left and right bass and high frequency band signals, respectively, and using the high frequency band signals in place of the broad band input signals in the system, recombining the bass band signals with the left and right high frequency band outputs of the system for the left and right front channel outputs.

BRIEF DESCRIPTION OF THE DRAWINGS

Other objects and advantages of the invention will become apparent upon reading the following detailed description and upon reference to the drawings in which.

While the invention will be described in connection with several preferred embodiments, it will be understood that it is not intended to limit the invention to those embodiments. On the contrary, it is intended to cover all alternatives, modifications and equivalents as may be included within the spirit and scope of the invention as defined by the appended claims.

DETAILED DESCRIPTION

Figure 1:
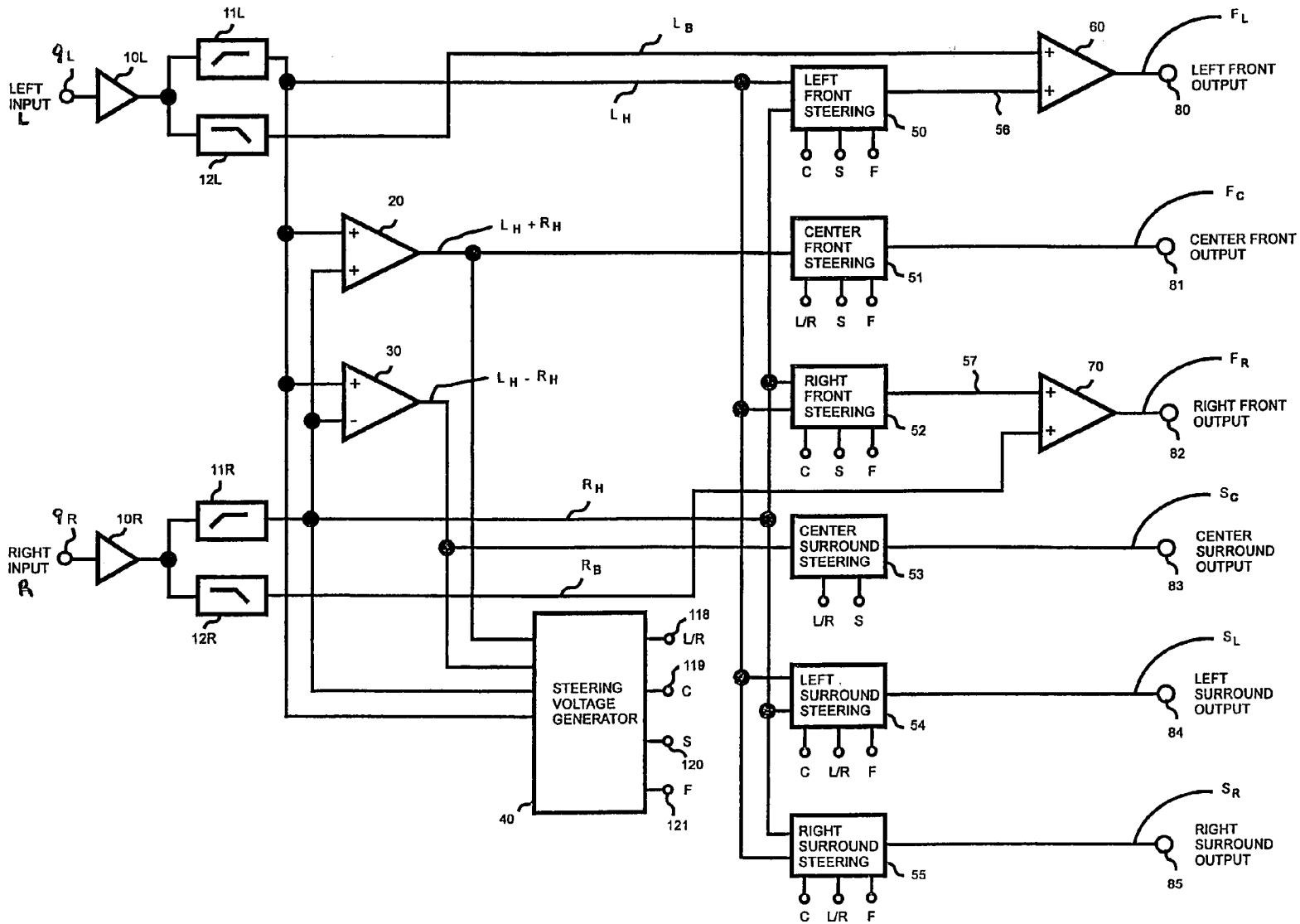
FIG. 1 is a partial block diagram/partial schematic diagram of the dynamic spectral matrix surround system.

Referring to FIG. 1, left and right stereo source signals L and R are applied to left and right inputs 9L and 9R. The stereo input signals L and R are buffered by buffer amplifiers 10L and 10R, providing buffered signals sufficient to drive the input crossover sections. The output of the left buffer amplifier 10L drives the inputs of both a high-pass filter 11L and a bass or low-pass filter 12L. The output of the right buffer amplifier 10R drives the inputs of both a high-pass filter 11R and a bass or low-pass filter 12R. The left filters 11L and 12L provide a 24 db per octave crossover for the left input signal L. 24 db per octave crossover filters are commonly known and used by the skilled artisan. One advantage of this type of filter is that the bands can be recombined to avoid any peaks or dips in the final frequency response as a result of phase coherency at the crossover point. The 24 db per octave filters allow the bass frequency signals to be crossed over at a higher crossover point and still provide excellent removal of all voice band audio from the unaltered bass portion of the audio spectrum. The output $L_B$ of the left low-pass filter 12L is fed directly to a summing amplifier 60 where the bass portion of the audio spectrum can be recombined with the left channel, upper frequency portion of the audio spectrum after the upper band signal $L_H$ has been processed. The left filters 11L and 12L provide a 24 db per octave crossover for the left input signal L at approximately 200 hz. This allows the bass frequency signal $L_B$ to be crossed over at a higher crossover point and still provide excellent removal of all voice band audio from the unaltered bass portion of the audio spectrum. This further provides a high band steered signal, with better removal of all bass frequency components, to avoid any dynamic modulation at the bass frequencies that can otherwise cause audible side effects in other systems. This allows the low-band portion of the audio spectrum to retain true stereo performance while simultaneously improving system performance to avoid the above mentioned audible low frequency modulation.

The output $R_B$ of the right bass or low-pass filter 12R is fed directly to another summing amplifier 70 where the bass portion of the audio spectrum can be re-combined with the right channel, upper frequency portion of the audio spectrum after the upper band signal $R_H$ has been processed. This provides the above mentioned left channel improvements for the right channel also. It should be noted that the left and right channel bass frequency signals $L_B$ and $R_B$ at the outputs of the low-pass filters 12L and 12R can also be summed with the left and right surround final outputs $S_L$ and $S_R$ to provide bass information in the outputs of these other channels. The outputs $L_B$ and $R_B$ of the low pass filters 12L and 12R can also be summed and added to the center channel outputs $F_C$ and $S_C$ if so desired. The above addition of the bass frequency signals $L_B$ and $R_B$ in the surround channels $S_L$ and $S_R$ is particularly desirable in automotive applications.

The left and right high-pass outputs $L_H$ and $R_H$ of the high pass filters 11L and 11R are applied to the inputs of sum and difference amplifiers 20 and 30 respectively. The output of the summing amplifier 20 provides a summed output $L_H+R_H$ of the high band portions $L_H$ and $R_H$ of the left and right input signals L and R. The difference amplifier 30 produces a left minus right difference output $L_H$–$R_H$ of the high band portions $L_H$ and $R_H$ of the left and right input signals L and R. The output $L_H$+$R_H$ of the summing amplifier 20 feeds the input of the center front steering circuit 51 and also provides one of the inputs to a steering voltage generator 40. The output $L_H$–$R_H$ of the difference amplifier 30 is fed to the input of the center surround steering circuit 53 and also to one of the inputs of the steering generator 40. The center surround output channel $S_C$ may be omitted in lower cost implementations of the invention or in systems that do not require this additional channel $S_C$, such as automotive and/or PC sound systems.

The high passed left and right outputs $L_H$ and $R_H$ of the high pass filters 11L and 11R are fed to the inputs of the left and right front and left and right surround steering circuits 50, 52, 54 and 55, respectively. The processed output signal 56 of the left front steering circuit 50 is fed to the other inputs of the first summing amplifier 60. The low-passed bass frequencies at the output $L_B$ of the left low pass filter 12L combined with the left front steering output 56 form a composite left front output signal $F_L$ at the left front channel output 80. The processed output signal 57 of the right front steering circuit 52 is fed to the other input of the other summing amplifier 70. The low-passed bass frequencies at the output $R_B$ of the right low pass filter 12R combined with the left front steering output 57 form a composite right front output signal $F_R$ at the right front channel output 82. The processed outputs of the center front steering circuit 51, the center surround steering circuit 53, the left surround steering circuit 54 and the right surround steering circuit 55 drive the other system channel outputs 81, 83, 84 and 85 to provide front center, surround center and surround left and right output signals $F_C$, $S_C$, $S_L$ and $S_R$, respectively.

The operation of the steering circuits 50–55 will be described in greater detail later. The outputs $L_H$, and $R_H$ of the high-pass filters 11L and 11R also fed to the input of the steering voltage generator 40. In operation, the four inputs $L_H$, $R_H$, $L_H$+$R_H$ and $L_H$–$R_H$ to the steering voltage generator 40 are used to produce the steering voltages L/R, C, S and F that control the audio path steering circuits 50–55 described above. The four output steering voltages L/R, C, S and F are provided at outputs, 118, 119, 120 and 121, respectively. These four steering voltages L/R, C, S and F are fed to the steering voltage inputs of the audio path steering circuits 50–55 as designated by the L/R, C, S, and F references.

Figure 2:
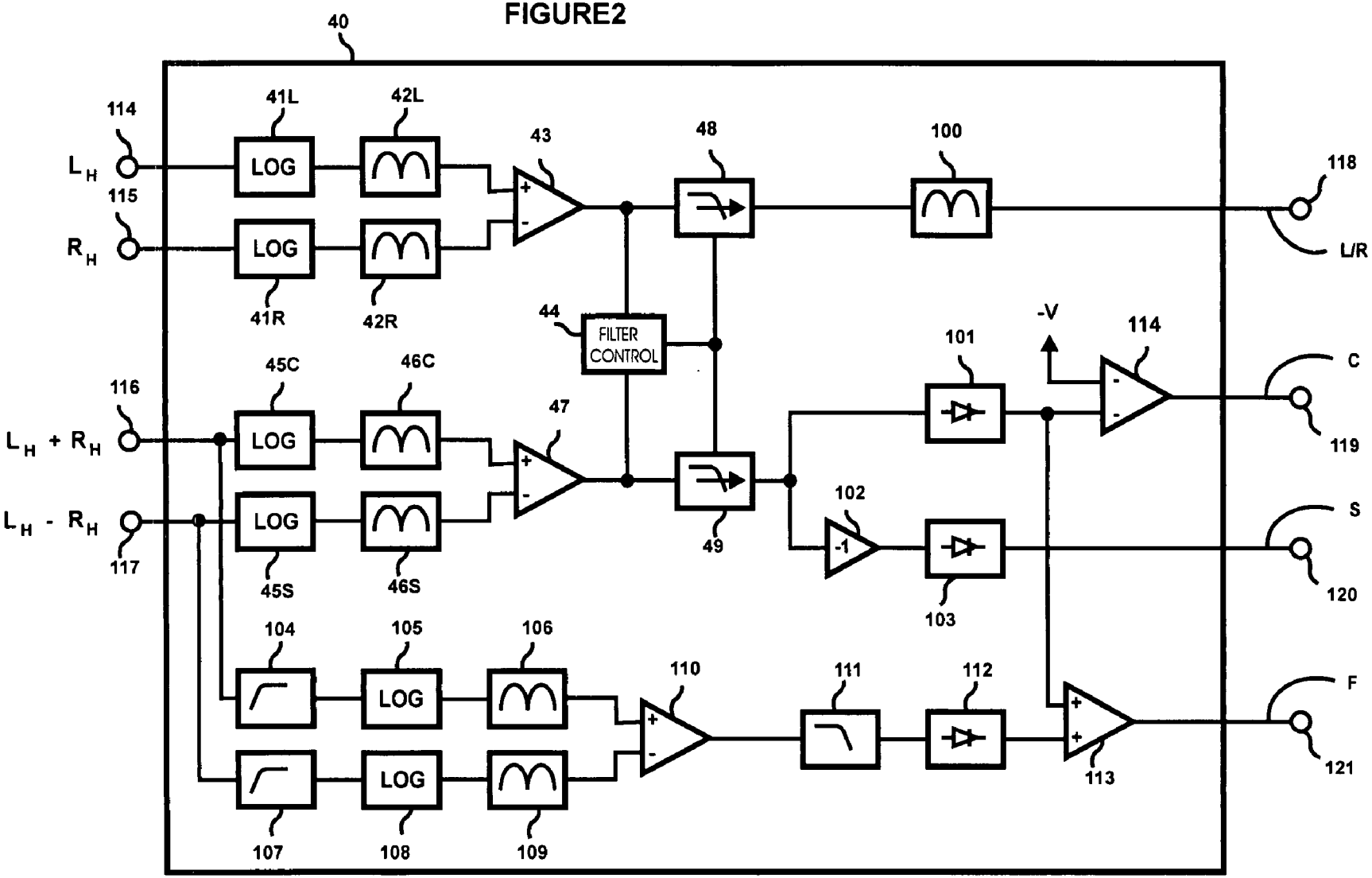
FIG. 2 is a block diagram of the steering voltage generator of FIG. 1.

The operation of the steering voltage generator 40 of FIG. 1 is described in greater detail with reference to FIG. 2. The steering voltage generator 40 receives the four input signals $L_H$, $R_H$, $L_H$+$R_H$ and $L_H$–$R_H$ previously described with reference to FIG. 1. As previously mentioned, these signals $L_H$, $R_H$, $L_H$+$R_H$ and $L_H$–$R_H$ have had all low band audio information removed by the left and right high pass filters 11L and 11R. This enhances the performance of the steering voltage generator 40 by only detecting the high-band portion of the audio spectrum where virtually all of the directional audio information is contained. As shown in FIG. 2, the high-passed left input signal $L_H$ is applied to an input 114 and feeds a left logging circuit 41L. The output of the left logging circuit 41L feeds the input of a full-wave rectifier circuit 42L. As will be apparent to the skilled artisan, the order of these two circuits can be changed with no real change in the net result. The logging and full-wave rectifier circuits 41L and 42L shown are the equivalent of those described in my U.S. Pat. No. 5,771,295. Other forms of level detection can be used, such as peak averaging, but with degraded system performance. The output of the full-wave rectifier 42L is equal to the absolute value of the logarithm of the high passed left input signal $L_H$ applied to the logging circuit 41L. The high-passed right input signal $R_H$ is applied at another input 115 and fed to another logging circuit 41R. The output of the logging circuit 41R feeds the input of another full-wave rectifier circuit 42R. The output of this full-wave rectifier 42R is equal to the absolute value of the logarithm of the high passed right input signal $R_H$ applied to the second logging circuit 41R. The design and operation of logging circuits and absolute value circuits are well known to the skilled artisan. Therefore, a more detailed description of these circuits is not required for the skilled artisan to build the invention. It will also be understood by anyone skilled in the art that the output of the full-wave rectifier circuits will be linear in volts per decibel. The output of the first full wave rectifier 42L feeds the positive input of a difference amplifier 43. The output of the second full wave rectifier 42R feeds the negative input of another difference amplifier 43. The resulting output of the first difference amplifier 43 is positive when there is a dominance in the left input signal L and negative when there is a dominance in the right input signal R.

The high-passed left plus right input signal $L_H$+$R_H$ is applied to a third input 116 and feeds a third logging circuit 45C. The output of the third logging circuit 45C feeds the input of a third full-wave rectifier circuit 46C. The high-passed left minus right input $L_H$–$R_H$ signal is applied to a fourth input 117 and feeds a fourth logging circuit 45S. The output of the fourth logging circuit 45S feeds the input of a fourth full-wave rectifier circuit 46S.

The output of the third full-wave rectifier 46C feeds the positive input of another difference amplifier 47. The output of the fourth full wave rectifier 46S feeds the negative input of the difference amplifier 47. The resulting output of the difference amplifier 47 is positive when there is a dominance in the left plus right input signal L+R and negative when there is a dominance in the left minus right input signal L–R. The output of the first difference amplifier 43 feeds both a variable low-pass filter 48 and a filter control circuit 44. The output of the second difference amplifier 47 feeds both a second varible low-pass filter 49 and the filter control circuit 44. When there is no dominant signal present at any one of the inputs, there will be no output signal present from the difference amplifiers 43 and 47. In this condition, the variable low-pass filters 48 and 49 will have a corner frequency at approximatley 1 Hz. The typical volt per decibel response at the output of the difference amplifiers 48 and 49 is on the order of 3 volts/decibel. When the output of either difference amplifier 43 or 47 exceeds 0.5 volts positive or negative, the filter control circuit 44 will start to increase the cut-off frequency of the variable low-pass filters 48 and 49. As the output of either difference amplifier 43 or 47 increases positive or negative from 0.5 volts to 3 volts, the cut-off frequency of the variable filters 48 and 49 will change in a relatively linear response from 1 Hz to approximately 16 Hz. This provides the proper response time for the control voltage signals to provide fast response time for sudden changes in dominance. This will provide a slow response when there is little or no directional dominance and also avoid distortion of the audio in the steering control circuits. The output or the first variable filter 48 feeds a full-wave rectifier circuit 100. The output of the rectifier circuit 100 is positive when there is dominance in either the left or the right input signal L or R. The output L/R of the full-wave rectifier 100 appears at the output 118 of the steering voltage generator 40.

The output of the second difference amplifier 47 feeds both the input of the second variable low-pass filter 49 and the filter control circuit 44. The operation of the second variable low-pass filter 49 and the filter control circuit with respect to the output signal of the second difference amplifier 47 is identical to that described above with reference to the first amplifier 43 and filter 48. When there is a dominance in the left plus right input signal L+R, the output of the second difference amplifier 47 will be positive. Conversely, when there is a dominance in the left minus right input signal L−R, the output of the second difference amplifier 47 will be negative. The output volt per decibel response of the second difference amplifier 47 will be the same as the first amplifier 43, 3 volts/decibel. The output of the second variable filter 49 feeds the input of a half wave rectifier 101. The output of the rectifier 101 will be positive when there is a positive voltage at the output of the variable filter 49 and will be 0 volts when the output of the variable filter 49 goes negative. The output of the half-wave rectifier 101 feeds one input of an inverting summing amplifier 114. The second input of the inverting summing amplifier 114 is tied to a negative reference voltage. The output of the inverting amplifier 114 feeds the center control voltge C that appears at another output 199 of the steering voltage generator 40. When the output of the half-wave rectifier 101 is at 0 volts, the output of the inverting summing amplifier 114 will be positive due to the negative reference voltage. The quiescent output voltage will be approximately 4 volts. The significance of this positive offset will be described later with reference to the steering circuits. The output of the second variable filter 49 also connects to the input of an inverting amplifier 102. The output of the inverting amplifier 102 connects to the input of a second half-wave rectifier 103. The second half wave rectifier 103 operates the same as the first half wave rectifier 101 and will provide a positive output only when the input signal is positive and will produce no output when the input is negative. When the output of the second variable filter 49 is negative, the output of the second half-wave rectifier 103 will be positive. The output of the second half-wave rectifier 103 feeds the surround output voltage S that appears at another output 120 of the steering voltage generator 40. In operation, the left plus right output L/R will go positive when there is a dominance in either the left or right input, L or R, the center output C will go positive when there is a dominance of left plus right L+R or center information in the input signals L and R, and the S output will become positive when there is a dominance of left minus right L−R or difference information L−R in the input signals L and R. The left plus right and left minus right input signals L+R and L−R also connect to the input of high-pass filters 104 and 107, respectively. The outputs of the high pass filters 104 and 107 feed fifth and sixth logging circuits 105 and 108 that feed fifth and sixth full-wave rectifiers 106 and 109, respectively. The output of the fifth rectifier 106 connects to the positive input of a third difference amplifier 110. The output of the sixth rectifier 109 connects to the negative input of the third difference amplifier 110. The operations of the fifth and sixth log converters 105 and 108, fifth and sixth full wave rectifiers 106 and 109 and the third difference amplifier 110 are identical to that described above. The high-pass filters 104 and 107 have a 12 db/octave response so as to provide an increasing sensitivity at high frequencies at the input to the fifth and sixth log converters 105 and 108. The result is that, when there is an increasing left plus right L+R or center frequency signal at the input 116 of the steering voltage generator 40, the output of the third difference amplifier 110 will produce an increasing output voltage. The output of the third difference amplifier 110 connects to the input of a third low-pass filter 111. The corner frequency of the filter 111 is on the order of 100 Hz. This provides a much faster response at the output of the filter 111 than is available from the variable filters 48 and 49. The output of the low-pass filter 111 feeds the input of a third half-wave rectifier 112. When the output of this filter 111 is positive, the output of the third half wave rectifier 112 will be positive. When the output of the filter 111 is negative, the output of the third half-wave rectifier 112 will be 0 volts. The output of the third half-wave rectifier 112 connects to one input of a summing amplifier 113. The second input of the summing amplifier 113 is connected to the output of the first half-wave rectifier 101. The outputs of both the first and third half-wave rectifiers 101 and 112 produce a 3 volt/decibel response. When there is strong de-correlated input signal and, simultaneously, the presence of dominant center information that does not contain a large amount of high frequency information, the output of the third difference amplifier 110 will produce a negative signal, and the output of the second difference amplifier 47 will be positive as a result of the presence of dominant broadband center information. Under this condition, the output of the difference amplifier 113 will be slightly positive due to the positive output at the first half wave rectifier 101. When there is a large amount of high frequency left plus right L+R or center information, the output of the third rectifier 112 will be strongly positive and, therefore, the output of the difference amplifier 113 will be strongly positive. The operation of the steering voltage generator 40 and the resulting control of the steering circuits will be further explained later, after a detailed description of the steering circuits.

Figure 3:
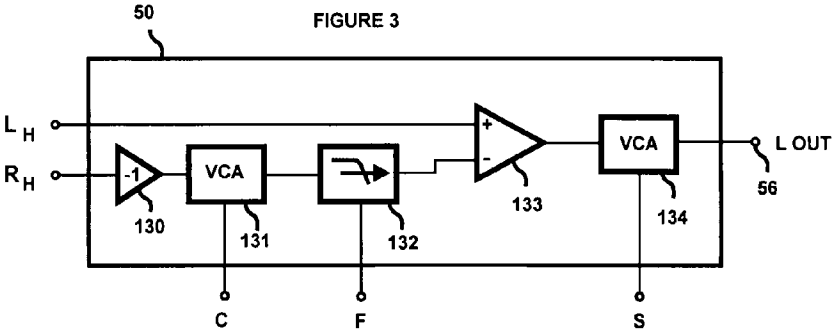
FIG. 3 is a block diagram of the left front steering circuit of FIG. 1.

Referring to FIG. 3, the left front steering circuit 50 will now be described. The left high-passed signal $L_H$ is applied to the positive input of a difference amplifier 133. The right high-passed input signal $R_H$ is applied to the input of an inverting amplifier 130. The output of the inverting amplifier 130 is connected to the input of a voltage controlled amplifier or VCA 131. VCA's are commonly known in the art and, therefore, a detailed description of the VCA need not be included. In the current invention, it is desirable to use a VCA that has a linear volt per decibel response to the control signal. The VCA 131 will have a control law such that at 0 volts, the VCA 131 will be at unity gain and the gain will vary linearly to −60 db with a control voltage of approximately 3 volts. This provides a 0.5 volt per 10 db response. The control port of the VCA 131 receives the center control signal C from the second output 119 of the steering voltage generator 40. The output of the VCA 131 feeds the input of a voltage controlled variable low-pass filter 132. Voltage controlled low-pass filters are well known in the art and are described in great detail in U.S. Pat. No. 5,736,899. The filter 132 used in the preferred embodiment of the invention has a corner frequency of 1 kHz when the control voltage is at 0 volts. When the control voltage is at approximatley 6 volts, the corner frequency of the filter 132 will be above 20 kHz. The filter 132 will vary in a relatively linear response over the control voltage range of 0 volts to approximately 6 volts. The control port of the variable low-pass filter 132 receives the frequency control signal F from the fourth output 121 of steering voltage generator 40. The output of the variable low-pass filter 132 connects to the negative input of a difference amplifier 133. The output of the difference amplifier 133 feeds the input of a second VCA 134. The output of the second VCA 134 feeds the left front steering output 56. The second VCA 134 has a control law similar to that of the first VCA 131 where 0 volts equals unity gain and the gain will attenuate as the control voltage is increased positive. The control port of the second VCA 134 receives the surround control signal S from the third output 120 of steering voltage generator 40. It becomes apparent that, when the gain of the first VCA 131 is at a minimum setting, no signal appears at the output of the first VCA 131. As a result, there will also be no output signal at the output of the filter 132. Thus, the output of the difference amp 133 will be equal to the left high band input $L_H$. If the gain of the second VCA 134 equals 1, then the left high band input signal $L_H$ will appear unaltered at the steering generator output 56. If the corner frequency of the filter 132 is above 20 kHz and the gain of the first VCA 131 is at unity, then the output of the difference amp 133 will equal the left high band input signal minus the right high band input signal $L_H-R_H$. This will cancel all center or left plus right information $L_H+R_H$ from the output 56 between 200 Hz to 20 kHz. If the corner frequency of the filter 132 were reduced to 3 kHz, the output of the difference amplifier 133 would equal the left high band input signal minus the right high band input signal $L_H-R_H$ from 200 Hz to 3 kHz and would equal the left high band input signal $L_H$ at frequencies above 3 kHz. It also becomes clear that if the steering voltage S at the control port of the second VCA 234 becomes positive, the signal level at the output 56 will be attenuated. Referring back to FIG. 2, the steering voltage C at the second output 119 will be at 4 volts when there is no dominant center channel signal present. This positive offset voltge will cause the fourth VCA 131 to attenuate to greater than −60 db. This attenuation will allow the left high band input signal $L_H$ to pass unaltered to the output 56. When the steering voltage C of the second output 119 of the steering generator 40 decreases, indicating an increase in center channel audio in the input, the gain of the first VCA 131 will increase. When the voltage C goes to 0 volts, the gain of the first VCA 131 will reach unity. The result is that the inverted right high band input signal will pass unaltered to the input of the filter 132.

Figure 4:
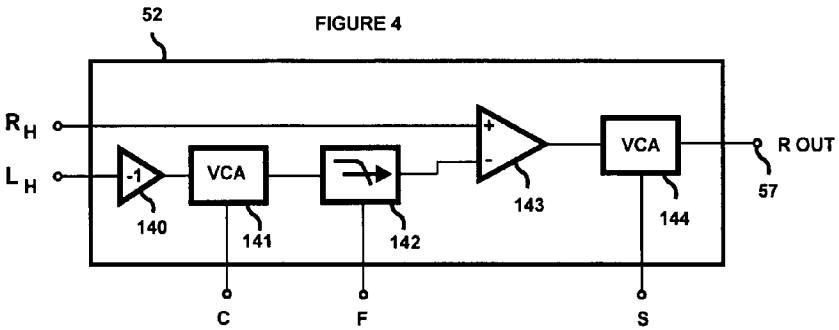
FIG. 4 is a block diagram of the right front steering circuit of FIG. 1.

Referring now to FIG. 4, the right front steering circuit 57 is described. The last digits of the reference designators used are the same as those of the left front steering circuit 50. The operation of the right front steering circuit 51 is identical to the left front steering circuit 50. The only difference is that the left and right high band input signals $L_H$ and $R_H$ are swapped. The positive input of the difference amplifier 143 receives the high-passed right input signal $R_H$ and the input of the inverting amplifier 140 receives the high-passed left input signal $L_H$. The final output of the VCA 144 drives the right output 57 of the first steering circuit 52.

Figure 6:
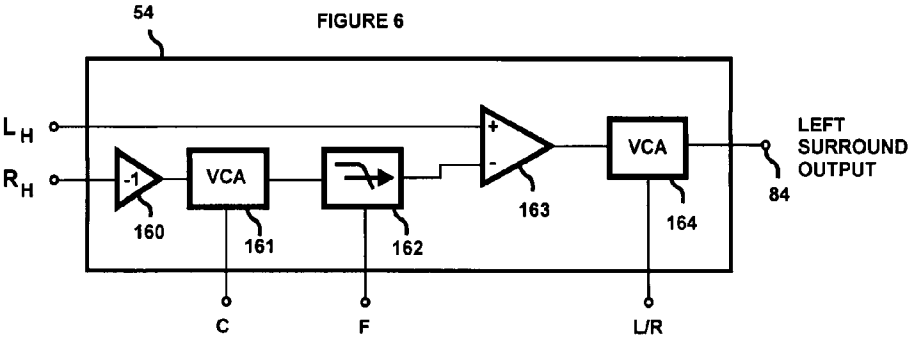
FIG. 6 is a block diagram of the left surround steering circuit of FIG. 1.
Figure 7:
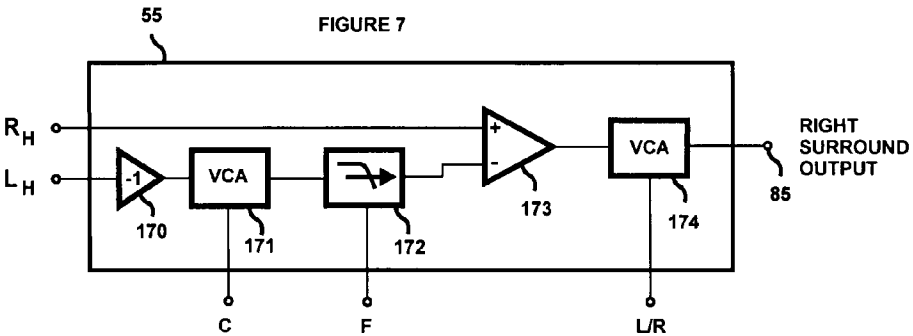
FIG. 7 is a block diagram of the right surround steering circuit of FIG. 1.

Referring now to FIGS. 6 and 7, the left surround and right surround steering circuits 54 and 55 will be described. The last digits of the reference designators used are the same as those used in the front steering circuits 50 and 52 to depict similar operation. The left surround steering circuit 54 is similar to the front steering circuit 50, including the left and right high band input signals $L_H$ and $R_H$. The operation of the left surround steering circuit 54 is similar to that explained above with reference to the left front steering circuit 50. The only difference between these two circuits is that the left surround steering circuit VCA 164 receives its control signal L/R from the first output 118 of the steering voltage generator 40. This means that, when there is a dominant left or right input signal L or R, the VCA 164 will attenuate, thereby reducing the level of the output $S_L$ at the left surround channel output 84. The right surround steering circuit 55 is similar to the right front steering circuit 52 including the left and right high band input signals $L_H$ and $R_H$. The only difference between these two circuits is that the right surround steering circuit VCA 174 receives its control signal L/R first output 118 of the steering voltage generator 40. This means that when there is a dominant left or right input signal L or R, the VCA 174 will attenuate, thereby reducing the level of the output $S_R$ at the right surround channel output 85.

Figure 5:
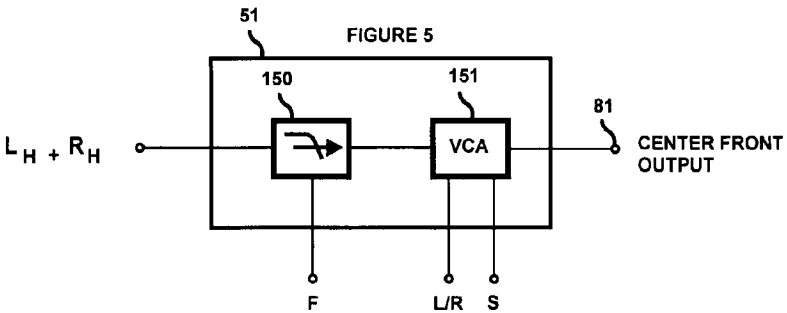
FIG. 5 is a block diagram of the center front steering circuit of FIG. 1.

Referring now to FIG. 5, the center front steering circuit 51 will be described. The high-passed summed left plus right signal $L_H+R_H$ is applied to the input of a variable low-pass filter 150. The filter 150 is similar to the filter 132 described above with reference to FIG. 3. The control port of the variable filter 150 received the control signal F from the fourth output 121 of the steering voltage generator 40 in FIG. 1. The output of the variable filter 150 is fed to the input of a VCA 151. The output $C_F$ of the VCA 151 feeds the center front channel output 81 in FIG. 1. Referring again to FIG. 5, the VCA 151 has two positive control ports which produce unity gain when the control voltage is at 0 volts and will provide attenuation when the control signal L/R or S on either port is positive. One control port receives the left/right control voltage L/R from the first output 118 of the steering voltage generator and the second control port receives the surround control voltage S from the third output 120 of the steering voltage generator 40. The filter 150 is designed to have a quiescent corner frequency of 3 kHz. Thus, in the absence of any dominant left plus right signal L+R or center channel information at the input to the system, the output bandwidth of the filter 150 will be 200 Hz to 3 kHz. This is sufficient bandwidth to cover voice band audio information but will attenuate higher frequency information that may be present in the stereo left and right input signals L and R. This will noticeably increase the impact of the stereo information at the left and right front channels outputs 80 and 82. When there is either an increase in dominant left plus right signal L+R or front center information at the input to the system, the center control voltage C at the second output 119 of the steering voltage generator 40 will increase and will cause the bandwidth of the filter 150 to increase. With an increase in the high band left plus right $L_H+R_H$ frequency spectrum and/or a strong increase in the dominant left plus right signal L+R information, the bandwidth of the filter 150 will increase to over 20 kHz. Center channel audio is attenuated when there is an increase in dominant left or right audio at the inputs of the system. The first control voltage L/R at the first steering voltage generator output 118 will increase, thereby causing the VCA 151 to attenuate. The VCA 151 will also produce increasing attenuation as the third control voltage S at the third steering voltage generator output 120 increases. This attenuation helps to reduce cross talk from surround channels into the front center channel when there is stereo surround encoded signal present.

Figure 8:
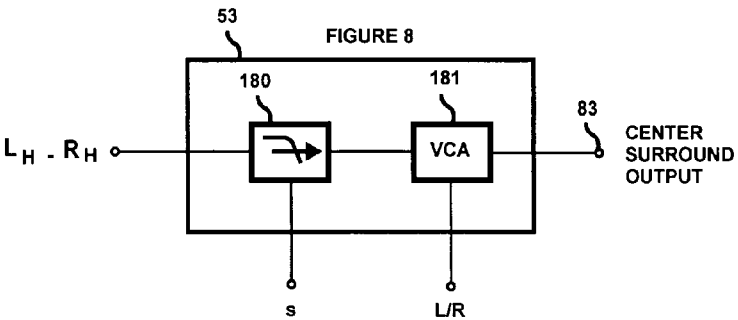
FIG. 8 is a block diagram of the center surround steering circuit of FIG. 1.

Referring now to FIG. 8, the center surround steering circuit 53 will be described. The center surround steering circuit 53 receives an audio input from the difference amplifier 30 in FIG. 1. The high-passed left minus right input signal $L_H-R_H$ is applied to the input of a variable filter 180. The control port of the variable filter 180 is connected to the third control voltage S at the third output 120 of the steering voltage generator 40. The output of the variable filter 180 feeds the input of a VCA 181. The control port of the VCA 181 is connected to the first control voltage L/R at the first output 118 of the steering voltage generator 40. The output $C_S$ of the VCA 181 feeds the center surround channel output 83 of the system. The quiescent corner frequency of the variable filter 180 is set to 3 kHz. This reduces the center surround channel bandwidth to a maximum of 3 kHz in the absence of any dominant surround information. The output of the VCA 181 will also attenuate when there is any dominant left or right input L or R to the system. The bandwidth of the center surround output 83 will increase to over 20 kHz only when there is a dominant left minus right signal L−R or surround signal present at the input. As previously mentioned, the center surround channel steering circuit 53 can be omitted in applications that do not benefit from this additional channel such as PC sound and automotive applications.

Looking now at the operation of all of the components together, it can be seen that, in the absence of any dominant directional signal at the input of the system, all the output control L/R, C, S and F voltages of the steering voltage generator 40 will be at 0 volts. Under this condition, the left front and left surround signals $F_L$ and $S_L$ at the channel outputs 80 and 84 of the system will be the same as the left input signal L. Conversely, the right front and right surround signals $F_R$ and $S_R$ at the channel outputs 82 and 85 will be the same as the right front input signal R. If the input signals L and R contain a dominant amount of center or left plus right L+R information in the spectral region from 200 Hz to 3 kHz and simultaneously contain stereo de-correlated high frequency information, the first control voltage will be 0 volts, the second control voltage C will be strongly positive, the third control voltage S will be 0 volts and the fourth control voltage F will be only slightly positive. This will cause the first VCA's 131, 141, 161 and 171 of the left front, right front, left surround and right surround circuits 50, 52, 54 and 55, respectively, to provide unity gain. At the same time, the corner frequency of the variable filters 132, 142, 162 and 172 of these circuits will be at approximately 3 kHz. The gain of the second VCA's 134, 144, 164 and 174 will be at unity. Thus, the signals $F_L$ and $S_L$ at the left front and second channel outputs 80 and 84 will be left minus right L−R from 200 Hz to 3 kHz and left L at frequencies above 3 kHz. The signals $F_R$ and $S_R$ at the right front and surround channel outputs 82 and 85 will be right minus left R−L from 200 Hz to 3 kHz and right R at frequencies above 3 kHz. This will provide a cancellation of the center channel voice band audio from the left and right channels while still providing true stereo operation in the spectrum above 3 kHz. This provides a tremendous improvement of the perceived left/right stereo separation. In the absence of any higher frequency stereo information, there would be noticeable leakage of center channel audio in the four left and right channels. This 3 Kz bandwidth is, however, sufficient in the presence of the higher frequency stereo information due to the fact that the higher frequency harmonic content of the center channel audio is subjectively masked by the higher frequency de-correlated stereo information present in the left and right output channels. The increase in the stereo separation of the system is a far grater benefit than a complete cancellation of all masked center channel harmonics still present in the left and right output channels. This is certainly a performance advantage when the system is used to decode non-encoded stereo music source material. Continuing with the complete system operation, when the input audio signal contains an increasing amount of center channel high frequency information, the voltage at the output of the third rectifier 112 in the steering voltage generator 40 will increase. This will produce an increasing control voltage F at the fourth output 121 of the steering voltage generator 40, and will result in an increase in the corner cut off frequency of the filters 132, 142, 162 and 172. The result is that the cancellation of center channel information in the left and right channels will increase in bandwidth, thus avoiding any un-masked leakage of high band center information in the left and right channels. If the input signal contains only voice band, center channel audio without any de-correlated, or stereo, information, then the output of the first rectifier 101 in the steering generator 40 will be sufficiently positive so as to cause the corner frequency of the variable filters 132, 142, 162 and 172 to increase above 20 kHz. This will ensure that there is no leakage of center channel audio information into the left and right output channels. Due to the fact that the system does not revert to L−R and R−L across the entire spectrum in the left and right front and left and right surround channels $F_L$, $F_R$, $S_L$ and $S_R$, there is a decrease in the amount of difference information when compared to other matrix decoding systems. The result is that the output of the described invention more closely replicates the balance of L+R to L−R information in the original recording. This will reduce the objectionable increase of reverberant information typical when decoding stereo source material with other matrix decoding systems.

Continuing with the system operation, when there is a center channel voice band signal and a strong stereo de-correlated signal, the system will work as described above. When there is a sudden but short increase in center channel high frequency information, such a sharp sibilance in a lead vocal, the time constant of the high frequency weighted summed and difference signals $L_H+R_H$ and $L_H-R_H$ at the output of the third rectifier 112 of the steering voltage generator 40 will be sufficiently fast. This will allow the steering circuit filters to respond quickly so as to avoid any side effects, such as spitting in the left and right channels. This time constant can be considerably faster than that of the VCA steering voltages without any concern of audible distortion in the audio. When there is a dominant increase in the left channel input L, the control voltage C at the second output 4L of the steering generator 40 will become 4 volts. The control voltage F at the fourth output 121 will be at 0 volts. There will be a positive control voltage L/R at the first steering voltage output 118. The positive 4 volts control voltage C at the second output 4L will cause the VCA's 131, 141, 161 and 171 to attenuate to greater than 60 db. This will return the system to true stereo operation in the left and right channels. The positive control voltage L/R at the first steering voltage output will cause all three surround channels $S_L$, $S_R$ and $S_C$ and the center front channel $F_C$ to attenuate. This will allow dominant left channel information to be output only in the left front channel 80. Conversely, when the right input channel becomes dominant, the control voltage C at the second steering voltage generator output 119 will be at 4 volts and the left/right control voltage L/R at the first steering generator output 118 will again be positive. This will allow dominant right channel input signals to output only in the right front channel 82. When there is a dominant L−R or surround signal, the control voltage C at the second steering voltage output 119 will be at 4 volts. The L/R control voltage L/r at the first steering generator output 118 will be at 0 volts. The control voltage F at the fourth steering generator output 121 will be at 0 volts. The control voltage S at the third steering generator output 120 will be positive. Since the second steering voltage C is at 4 volts, any stereo difference or surround information will appear in the left and right surround channels 84 and 85. Since the third control voltage S will be positive, the VCA's 134 and 144 in the left and right front steering circuits 50 and 52 will attenuate and the output signal will only be present in the surround channels. The positive steering voltages at the third steering generator output 120 will also increase the corner frequency of the variable filter 180 of the center surround steering circuit 53. This will provide an increased bandwidth signal in the output of the center surround channel 83. A full 20 kHz response will only be present in the center surround channel 83 when there is a dominant center surround signal L−R present in the input.

Figure 9:
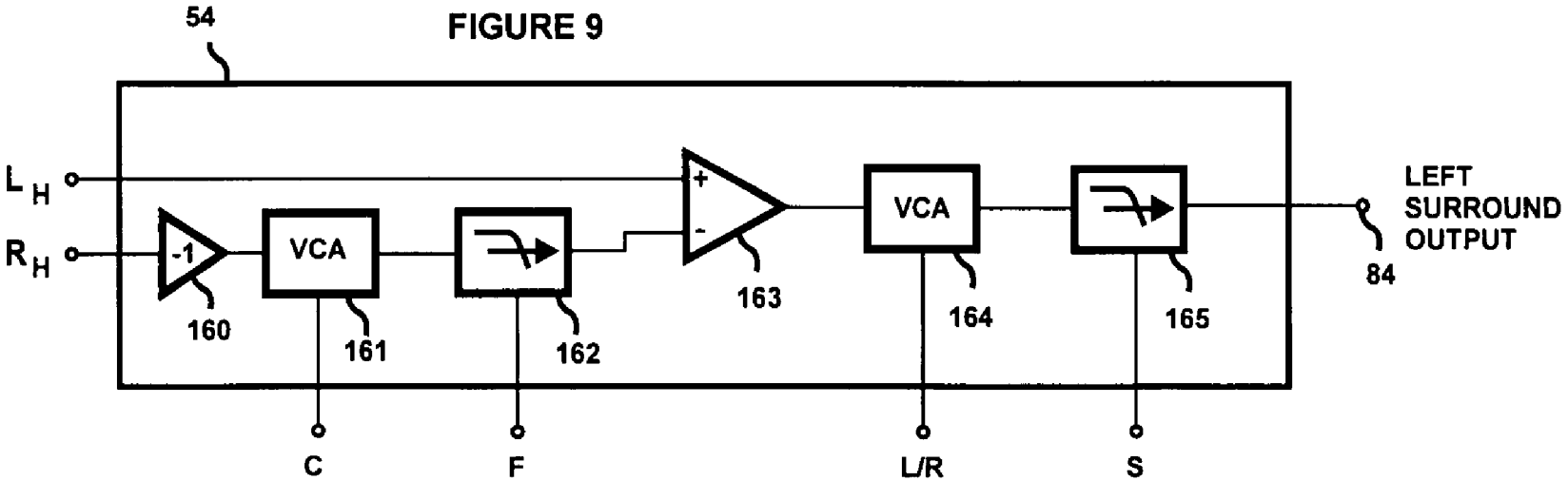
FIG. 9 is a block diagram of the left surround steering circuit, which includes an additional dynamic filtering enhancement.
Figure 10:
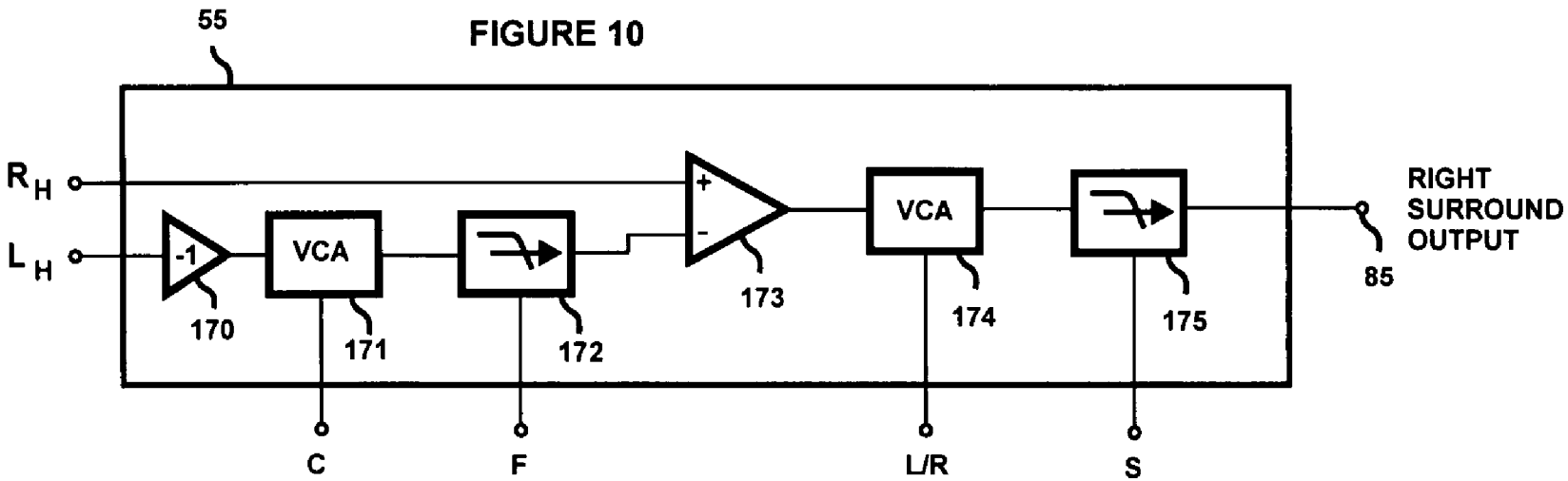
FIG. 10 is a block diagram of the right surround steering circuit which includes an additional dynamic filtering enhancement.

Referring now to FIGS. 9 and 10, the left surround steering circuit 54 and the right surround steering circuit 56 are shown in a system which further includes additional variable filters in the final outputs. The left surround steering circuit 54 includes an additional variable low-pass filter 165 which operates with the same response as that of the filter 180 in FIG. 8. The right surround steering circuit 55 also includes an additional variable low-pass filter 175. The quiescent corner frequency of the added variable filters 165 and 175 is set to 3 kHz. This reduces the surround channel bandwidth to a maximum of 3 kHz in the absence of any dominant surround information. The control ports of the added variable filter 165 and 175 connect to the control voltage S at the third output 120 of the steering voltage generator 40. The control response of the added variable filters 165 and 175 will provide a 3 kHz corner frequency of 0 volts and will linearly increase to over 20 kHz at 6 volts. In operation, when the input of the system includes any dominance in front, left or right, the bandwidth of the surround channels will not exceed 3 kHz. This is actually sonically closer to the perceived natural reflections present in an acoustical environment. This will improve the perceived separation between the front and surround channels while simultaneously providing a more close approximation of a real acoustic environment. The bandwidth of the surround channels will slightly increase above 3 kHz if the input contains a large amount of stereo de-correlated information. When there is an encoded dominant surround signal in the input, which is intended to produce directional impact in the surround channels, the control voltage S at the third output 120 of the steering voltage generator 40 will increase. This will cause the corner frequency of the added filters 165 and 175 to increase, allowing the dominant surround signal to be reproduced at full bandwidth. The operation of the additional elements of left and right surround steering circuits 54 and 55 are the same as described above in reference to FIGS. 6 and 7.

Figure 11:
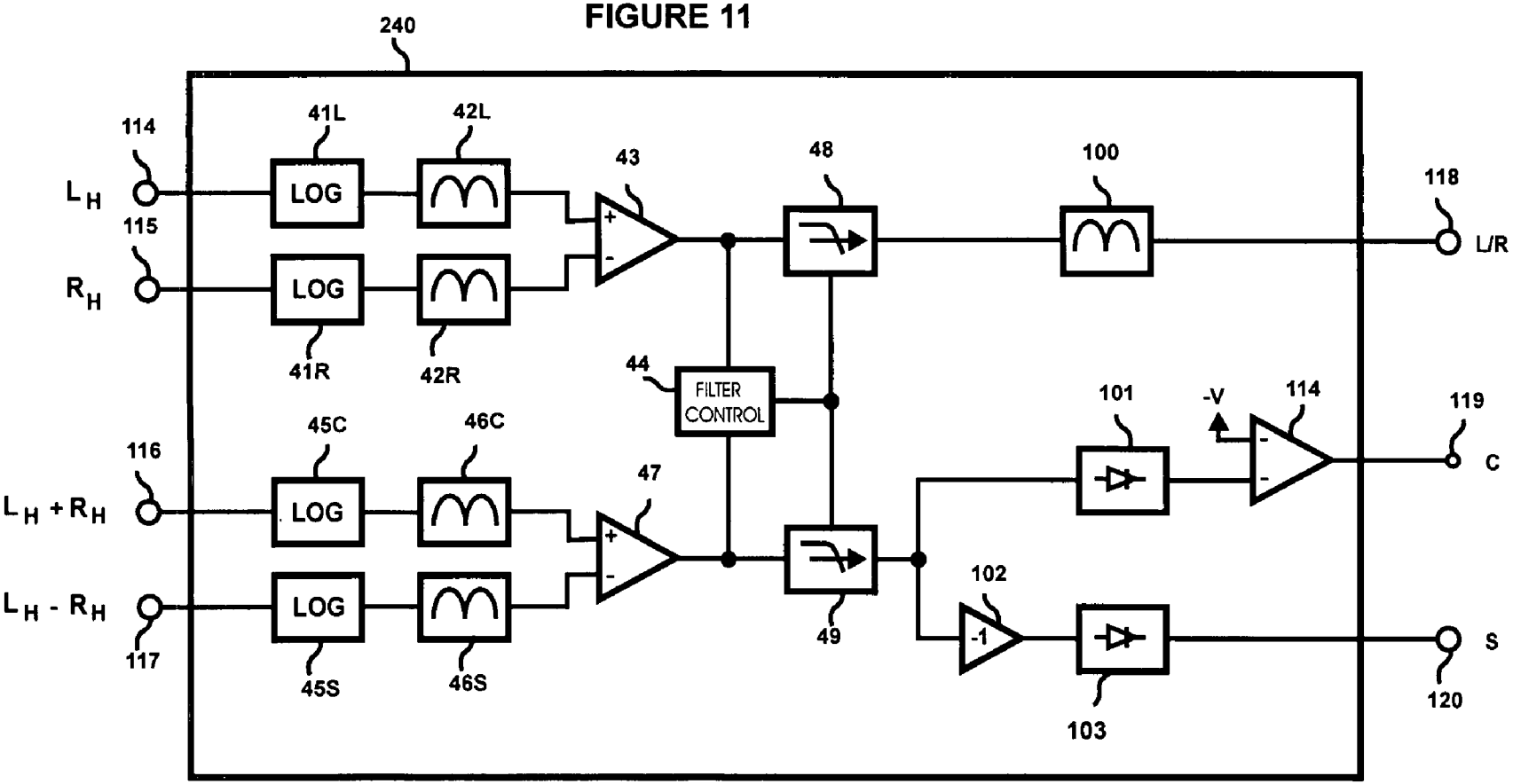
FIG. 11 is a block diagram of simplified implementation of the steering voltage generator circuit of FIG. 1.
Figure 12:
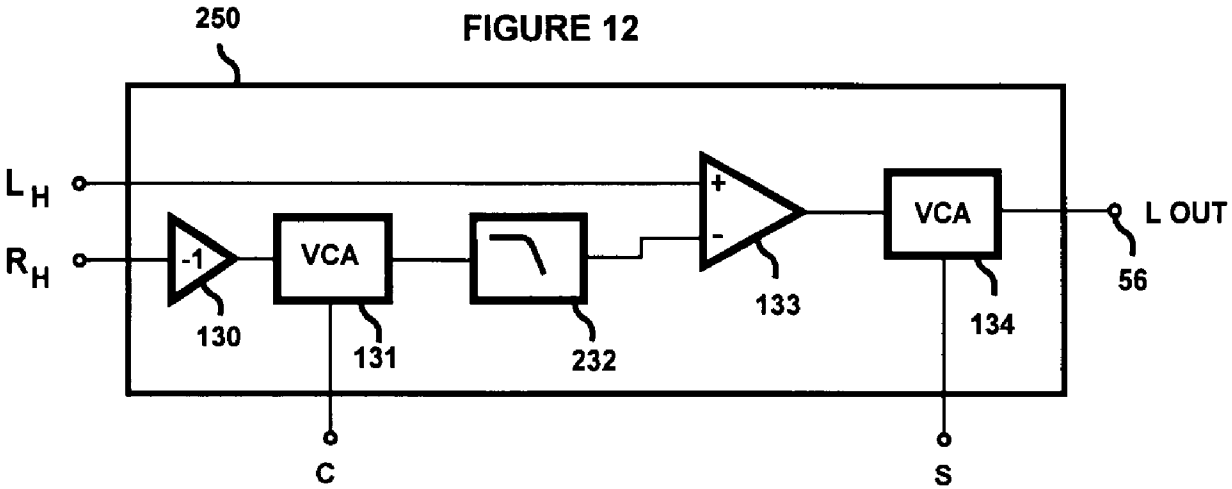
FIG. 12 is a block diagram of a simplified left front surround steering circuit.
Figure 13:
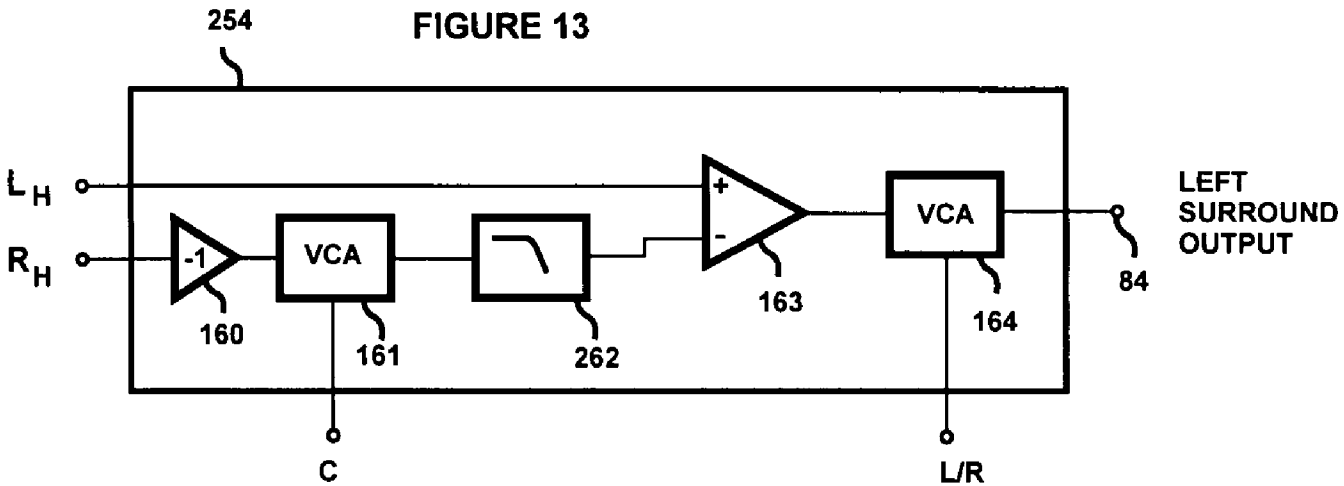
FIG. 13 is a block diagram of a simplified right front surround steering circuit.

Referring now to FIGS. 11–13, a lower cost embodiment of the invention will be described. There are applications for the invention where a lower cost alternative with slightly reduced performance will be desirable. FIG. 11 illustrates a simplified steering voltage generator 240 where the weighted high-passed L+R/L−R difference circuit and all of the associated frequency controlling elements are omitted. The designations used in FIG. 11 are the same as those used in FIG. 2 to indicate identical functions. The operation of the steering voltage generator 240 described in FIG. 11 is identical to that described in FIG. 2 except with the removal of the high frequency weighted L+R/L−R detection path. Referring now to FIGS. 12 and 13, the left front and left surround steering circuits 250 and 254 are shown. The right front and right surround steering circuits functions are the same as described below except for the required change in inputs and outputs signals. The numbers used in FIGS. 12 and 13 are the same as those used in FIG. 3 and FIG. 6 to indicate identical functions. However, the variable filters 132 and 162 in FIGS. 3 and 6 respectively are replaced by fixed filters 232 and 262 in FIGS. 12 and 13. The fixed filters 232 and 262 are single pole 6 db per octave filters having a 3 db or corner frequency at approximately 6 kHz. When the control voltage C at the second output 119 of the steering generator 40 is at 0 volts, the VCA's 131 and 161 will be at unity gain. The output 56 of the left steering circuit 250 will be L−R at frequencies below 6 kHz and L at frequencies above 6 kHz. This will provide cancellation of the center channel information at frequencies below 6 kHz. The output of the left surround steering circuit 254 will be L−R at frequencies below 6 kHz and L at frequencies above 6 kHz. This will provide cancellation of the center channel information at frequencies below 6 kHz as described above. The result is that, at frequencies above 6 kHz, the system will maintain true stereo performance. This allows the higher frequency information where most of the stereo cues are present to produce true stereo performance. All other operation of the system is identical to that previously described with reference to the previous drawings. This novel approach to providing surround channels by canceling front center information in the surround channels only at the point in time that center information is present and providing full bandwidth, true stereo in the absence of any dominant center signal is a major improvement over other surround decoding systems.

The teachings regarding the use of all pass phase-shift circuits contained in U.S. Pat. No. 5,319,713 can also be applied to this disclosure.

Thus, it is apparent that there has been provided, in accordance with the invention, a dynamic spectral matrix surround system that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A process for dynamically decoding two channel stereo into multi-channel sound comprising the steps of:

feeding left and right input signals to left and right front and surround channel outputs, respectively;

summing the left and right input signals to provide a summed signal;

determining when the summed signal is dominant;

dynamically varying the amplitude of the right and left input signals; and subtracting the dynamically varied right and left input signals from the left and right surround channel outputs, respectively, when the summed signal is dominant.

2. A process according to claim 1 further comprising the step of feeding the summed signal to a center front channel output.

3. A process according to claim 2 further comprising the step of differencing the right and left input signals to provide a center surround signal at a center surround channel output.

4. A process for dynamically decoding two channel stereo into multi-channel sound comprising the steps of:

feeding left and right input signals to left and right front and surround channel outputs, respectively;

filtering the left and right input signals over a preselected bandwidth to provide left and right filtered signals;

summing the left and right input signals to provide a summed signal;

determining when the summed signal is dominant;

dynamically varying the amplitude of the right and left input signals; and subtracting the dynamically varied left and right filtered signals from the right and left surround channel outputs, respectively, when the summed signal is dominant.

5. A process according to claim 4 further comprising the step of filtering the summed signal over the preselected bandwidth to provide a center front signal at a center front channel output.

6. A process according to claim 5 further comprising the steps of:

differencing the right and left input signals to provide a differenced signal; and filtering the differenced signal over the preselected bandwidth to provide a center surround signal at a center surround channel output.

7. A process for dynamically decoding two channel stereo into multi-channel sound comprising the steps of:

feeding left and right input signals to left and right front and surround channel outputs, respectively;

dynamically filtering the left and right input signals over a preselected bandwidth to provide left and right dynamically filtered signals;

summing the left and right input signals to provide a summed signal;

determining when the summed signal is dominant; and subtracting the left and right dynamically filtered signals from the right and left surround channel outputs, respectively, when the summed signal is dominant.

8. A process according to claim 7 further comprising the step of dynamically filtering the summed signal over the preselected bandwidth to provide a center front signal at a center front channel output.

9. A process according to claim 8 further comprising the step of:

differencing the right and left input signals to provide a differenced signal; and dynamically filtering the differenced signal over the preselected bandwidth to provide a center surround signal at a center surround channel output.

10. A process for dynamically decoding two channel stereo into multi-channel sound comprising the steps of:

splitting a left input signal and a right input signal into left and right bass and high frequency band signals, respectively;

feeding the left and right high frequency band signals to left and right surround channel outputs, respectively;

summing the left and right high frequency band signals to provide a summed high frequency band signal;

determining when the summed high frequency band signal is dominant;

dynamically varying the amplitude of the left and right high frequency band signals;

subtracting the dynamically varied right and left high frequency band signals from the left and right surround channel outputs when the summed high frequency band signal is dominant;

subtracting the dynamically varied right and left high frequency band signals from the left and right high frequency band signals, respectively, when the summed high frequency band signal is dominant to provide left and right processed high frequency band signals; and combining the left bass band signal and the left processed high frequency band signal and the right bass band signal and the right processed high frequency band signal to provide left and right front channel outputs, respectively.

11. A process according to claim 10 further comprising the step of feeding the summed high frequency band signal to a center front channel output.

12. A process according to claim 11 further comprising the step of differencing the left and right high frequency band signals to provide a differenced high frequency band signal at a center surround channel output.

13. A process for dynamically decoding two channel stereo into multi-channel sound comprising the steps of:

splitting a left input signal and a right input signal into left and right bass and high frequency band signals, respectively;

filtering the left and right high frequency band signals over a preselected bandwidth to provide left and right filtered signals, respectively;

summing the left and right high frequency band signals to provide a summed high frequency band signal;

determining when the summed high frequency band signal is dominant;

dynamically varying the amplitude of the right and left filtered signals;

subtracting the dynamically varied right and left filtered signals from the left and right high frequency band signals, respectively, when the summed high frequency band signal is dominant to provide left and right processed signals at left and right surround channel outputs, respectively; and combining the left bass band signal and the left processed signal and the right bass band signal and the right processed signal to provide left and right front output signals at left and right front channel outputs, respectively.

14. A process according to claim 13 further comprising the step of filtering the summed high frequency band signal over the preselected bandwidth to provide a center front output signal at a center front channel output.

15. A process according to claim 14 further comprising the steps of:

differencing the left and right high frequency band signals to provide a differenced high frequency band signal; and filtering the differenced high frequency band signal over the preselected bandwidth to provide a center surround output signal at a center surround channel output.

16. A process for dynamically decoding two channel stereo into multi-channel sound comprising the steps of:

splitting a left input signal and a right input signal into left and right bass and high frequency band signals, respectively;

dynamically filtering the left and right high frequency band signals over a preselected bandwidth to provide left and right dynamically filtered signals, respectively;

summing the left and right high frequency band signals to provide a summed high frequency band signal;

determining when the summed high frequency band signal is dominant;

subtracting the right and left dynamically filtered signals from the left and right high frequency band signals, respectively, when the summed high frequency band signal is dominant to provide left and right processed signals at left and right surround channel outputs, respectively; and combining the left bass band signal and the left processed signal and the right bass band signal and the right processed signal to provide left and right front output signals at left and right front channel outputs, respectively.

17. A process according to claim 16 further comprising the step of dynamically filtering the summed high frequency band signal over the preselected bandwidth to provide a center front output signal at a center front channel output.

18. A process according to claim 17 further comprising the steps of:

differencing the left and right high frequency band signals to provide a differenced high frequency band signal; and dynamically filtering the differenced high frequency band signal over the preselected bandwidth to provide a center surround output signal at a center surround channel output.

19. A process for dynamically decoding two channel stereo into multi-channel sound comprising the steps of:

feeding left and right input signals to left and right front and surround channel outputs, respectively;

inverting the left and right input signals;

summing the left and right input signals to provide a summed signal;

determining when the summed signal is dominant; and dynamically varying the amplitude of the left and right inverted signals; and adding the dynamically varied left and right inverted signals to the right and left surround channel outputs, respectively, when the summed signal is dominant.

20. A process according to claim 19 further comprising the step of feeding the summed signal to a center front channel output.

21. A process according to claim 20 further comprising the step of differencing the right and left input signals to provide a center surround signal at a center surround channel output.

22. A process for dynamically decoding two channel stereo into multi-channel sound comprising the steps of:

feeding left and right input signals to left and right front and surround channel outputs, respectively;

summing the left and right input signals to provide a summed signal;

differencing the left and right input signals to provide a differenced signal;

determining which of the left input, right input, summed and differenced signals is dominant;

generating a left/right variable dc control signal in response to dominance of one of the left and right input signals;

generating a center variable dc control signal in response to dominance of the summed signal;

generating a surround variable dc control signal in response to dominance of the differenced signal;

inverting the left and right input signals;

attenuating the inverted left and right input signals in response to the center control signal;

combining the left and right input signals with the attenuated inverted right and left input signals, respectively to provide left and right processed signals, respectively;

attenuating the left and right processed signals in response to the surround control signal to provide left and right attenuated processed signals;

combining the left and right input signals with the left and right attenuated processed signals, respectively, to provide left and right front signals at left and right front channel outputs, respectively; and attenuating the left and right processed signals in response to the left/right control signal to provide left and right surround signals at left and right surround channel outputs.

23. A process according to claim 22 further comprising the step of attenuating the summed signal in response to the left/right and surround control signals to provide a center front signal at a center front channel output.

24. A process according to claim 23 further comprising the step of attenuating the differenced signal in response to the left/right control signal to provide a center surround signal at a center surround channel output.

25. A process according to claim 22 further comprising the step of generating a frequency variable dc control signal which is proportional to the quantity of high frequency information contained in the summed signal in response to dominance of the summed signal, said step of combining signals to provide left and right attenuated processed signals comprising the substeps of:

filtering the attenuated inverted right and left input signals over a preselected bandwidth in response to the frequency control signal; and combining the filtered right and left signals with the left and right input signals, respectively.

* * * * *